United States Patent [19]

Marcellaro

[11] 4,447,911

[45] May 15, 1984

[54] JUMPSUIT

[76] Inventor: Irene C. Marcellaro, 1746 Princeton Ave., Trenton, N.J. 08638

[21] Appl. No.: 183,967

[22] Filed: Sep. 3, 1980

[51] Int. Cl.[3] ..... A41D 13/02

[52] U.S. Cl. ..... 2/79

[58] Field of Search ..... 2/79, 78 B, 78 R, 80

[56] References Cited

U.S. PATENT DOCUMENTS

| | | | |
|---|---|---|---|
| 1,284,391 | 11/1918 | Luckett | 2/78 B |
| 1,341,313 | 5/1920 | Godchaux | 2/79 |
| 1,435,756 | 11/1922 | Sweeney | 2/79 |
| 1,470,356 | 10/1923 | Graham | 2/79 X |
| 1,806,794 | 5/1931 | Donnelly | 2/79 X |
| 1,976,126 | 10/1934 | Hickerson | 2/79 |
| 2,131,177 | 9/1938 | Horton et al. | 2/79 |
| 3,949,427 | 4/1976 | Sampey | 2/79 |

*Primary Examiner*—H. Hampton Hunter

*Attorney, Agent, or Firm*—Barry L. Haley

[57] ABSTRACT

A unitary garment generally known as a "jump suit" having hidden access flaps in the seat portion which can be easily opened and closed to allow the wearer to use toilet facilities without completely removing the garment. The access flaps are formed from a horizontal separation across the garment back at the waist and an invisible zipper which starts at the crotch rear area and extends vertically to and intersects the waistline area at the separation. A piece of elasticized material is attached to the garment above the separation and extends downward and covers the separation when the zipper is closed. A plurality of snaps or hook fasteners are spaced apart along the edges of the waist separation to secure the flaps to the upper waist portion of the garment. In another embodiment the elasticized material is integral the garment, giving even a more finished appearance to the garment.

1 Claim, 16 Drawing Figures

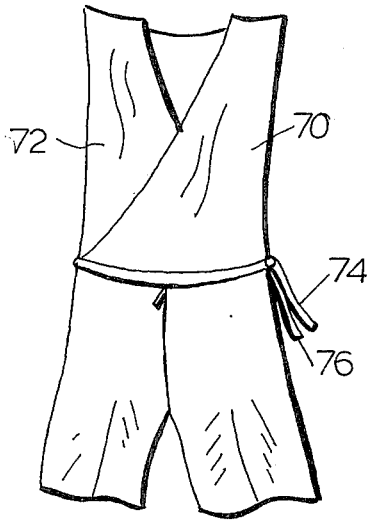
FIG. 11
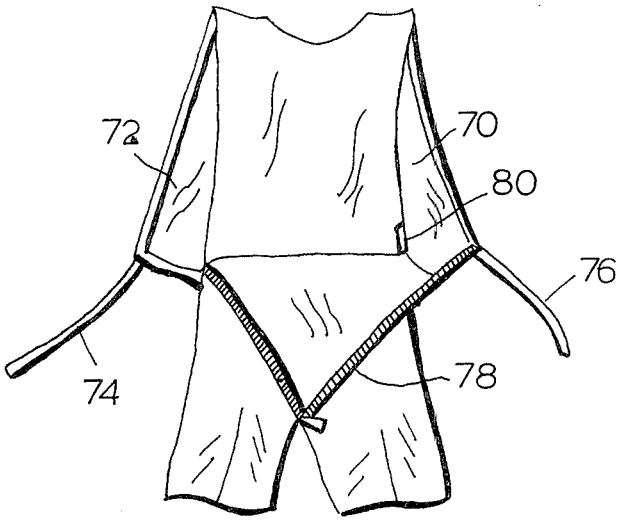
FIG. 12
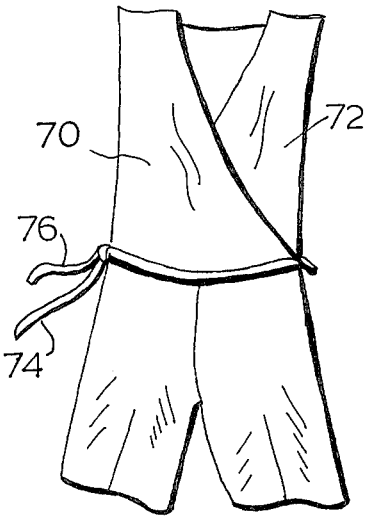
FIG. 13
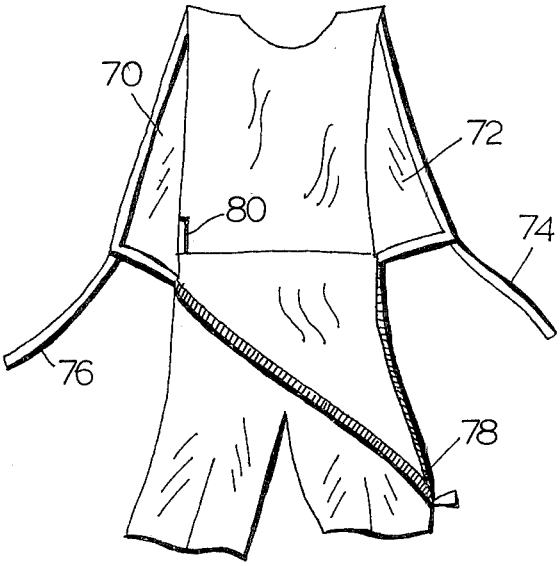
FIG. 14
FIG. 15
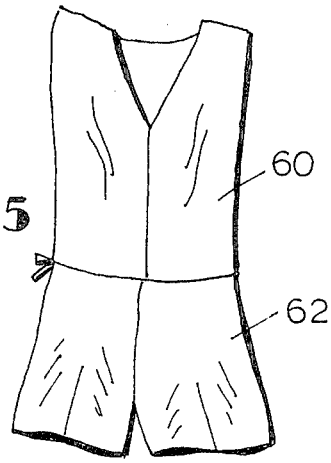
FIG. 16
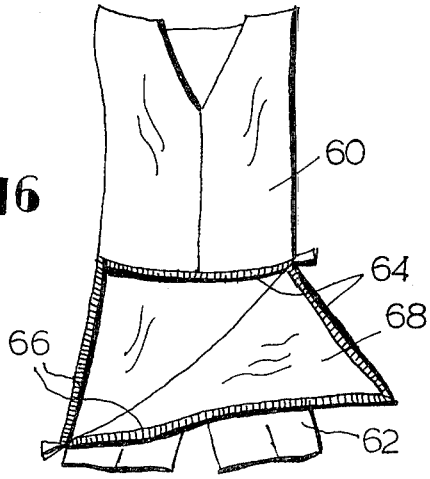

JUMPSUIT

BACKGROUND OF THE INVENTION

The present invention relates to access panels for garments and more particularly to hidden access panels in the seats of garments of unitary construction. Various types of garment drop seats have been proposed, for example, in U.S. Pat. Nos. 3,852,824 and 3,949,427. An improved seat has been needed to allow the wearer to open the seat without difficulty, to maintain garment structural integrity and fit, and at the same time to maintain an aesthetically fashionable look desirable in the business of couture.

The present invention affords a solution to the problem of providing garments of unitary construction so that the wearer can use toilet facilities without disrobing and without detracting, reducing or diminishing the aesthetic appearance of the garment or the fitting characteristics.

SUMMARY OF THE INVENTION

In accordance with the present invention, a hidden access panel having a single vertical invisible zipper extending from the crotch to a horizontal panel, split at the waist, is provided. When said zipper is in the open position, a pair of fold down flaps are formed by the sides of the horizontal split and the zipper panel sides in the seat of the garment. When said zipper is in the closed position, an elongated piece of elasticized material attached to the garment along the upper edge of the waist separation and extending downwardly covers and hides said horizontal separation, in normal usage. Separable clasps or fasteners are used to hold the waist separation edges together.

In the alternate embodiment the elasticized material is made integral the garment thus giving even a more finished appearance to the garment.

In another embodiment a halter top garment is provided which has a single piece of material as the upper portion with two overlapping flaps in the rear each having their lower edge portion stitched to the lower portion of the jumpsuit. The corner of each flap nearest the waistline has a drawstring attached thereto which can extend around to the front of the jumpsuit and can be tied to hold the rear overlapping flaps in place. In this arrangement the lower portion of the jumpsuit has a zipper either located in the back seam of the jumpsuit and running from the upper edge of the lower portion vertically to the crotch or the zipper can be located on either side seam of the jumpsuit and run from the upper edge of the lower portion vertically to approximately the crotch level of the garment. In order to expose the rear torso portion, the wearer simply unzips the zipper and unties the drawstrings and separates the overlapping panels of the upper portion from each other exposing the rear torso portion.

In another embodiment, the rear upper portion of the jumpsuit is connected to the rear lower portion of the jumpsuit by way of a zipper which runs approximately from one side of the garment to the other side or approximately 180°. A second zipper, on either side of the garment is installed to run from the upper edge of the lower portion to approximately the level of the crotch down the leg of the garment so that when both zippers are open a singular triangular flap can be folded out of the way exposing the rear torso portion.

It should be noted in all of the embodiments, the zipper is made integral the seam to give the appearance of a normal seam and therefore not detracting from the fashionable appearance of the garment.

Accordingly it is an object of the present invention to provide a hidden seat panel for unitary garments, with a means of easily opening said access panel without removing the garment.

Another object of the present invention is to provide a hidden seat panel for unitary garments that does not detract or diminish the aesthetic appearance of the garment.

It is another object of this invention to provide a novel and improved hidden access panel for unitary garments, with a means of easily opening said access panel without completely removing the garment, the hidden panel being structurally supportive to maintain proper garment fit.

In accordance with these and other objects which will be apparent hereinafter, the instant invention will now be described with particular reference to the accompanying drawings.

BRIEF DESCRIPTION OF THE DRAWINGS

FIG. 11 is a back elevational view showing an alternate embodiment of the invention in the closed position.

FIG. 12 shows the hidden panel of the embodiment of FIG. 11 in the open position.

FIG. 13 shows a back elevational view of another embodiment of the invention in the closed position.

FIG. 14 shows the embodiment of FIG. 13 in the open position.

FIG. 15 is a back elevational view of another embodiment of the invention in the closed position.

FIG. 16 shows the embodiment of FIG. 15 in the open position.

PREFERRED EMBODIMENT OF THE INVENTION

Figure 1:
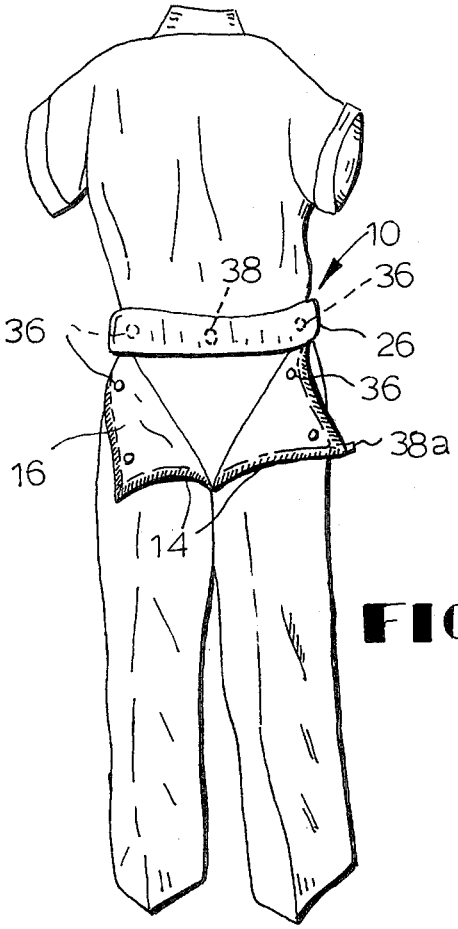
FIG. 1 is a back elevational view showing a jump suit employing the instant invention, the zipper being in the open position.

Referring now to the drawings, and specifically FIG. 1, the instant invention is shown as part of a jump suit 10 which is a unitary garment which fits about the upper and lower torso and includes sleeves and leg portions, with the garment being constructed to cover the body of the wearer from the shoulders substantially to the ankles. Access in the conventional jump suit is with a front zipper, not shown in FIG. 1, which extends down from the top to the front crotch area which allows one to completely remove or put on the garment. However, when using the toilet facilities it is very cumbersome to remove and drop the garment in this fashion.

In FIG. 1, the rear of a jumpsuit is shown with flaps 16 and 18 opened by virtue of zipper 14 being open which allows for the exposure of the rear torso portion of the wearer. The garment panels 16 and 18 have an elasticized upper edge portion and include fasteners 36 and a hook 38*a* connected along the outside upper edge portion. The waist band 26 is elasticized and includes on its inner lower flap portion fasteners 36 and hook 38. The upper portion of the jump suit terminates in a waist panel which is connected to the waistband 26 with the waistband providing a lower lip portion which extends downwardly over the upper edges of the flaps when they are in the closed position.

Figure 2:
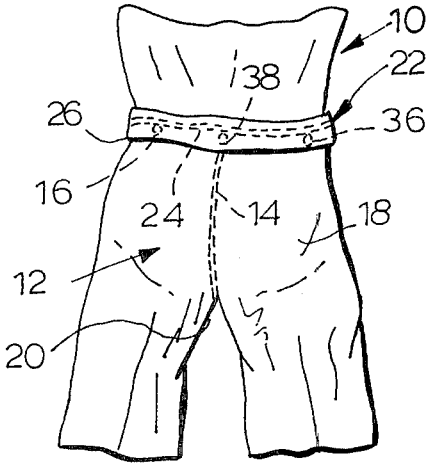
FIG. 2 shows the hidden panel of the instant invention in a closed position.

FIG. 2 shows the garment as it is normally worn with the zipper 14 enclosed and hidden, the flaps 16 and 18 being secured to the elasticized waistband 26 by the fasteners 36 and hook 38. The waistband 26 overlaps the upper flap edges 24, hiding them from view, giving the garment a complete unitary appearance, while the fasteners and hook in conjunction with the elasticized waistband and elasticized edges of the flaps 16 and 18 provide structural rigidity, ensuring a proper fit of the garment, preventing sagging or the like while completely hiding the access panel and separation between the flaps and the waist panel.

Figure 3:
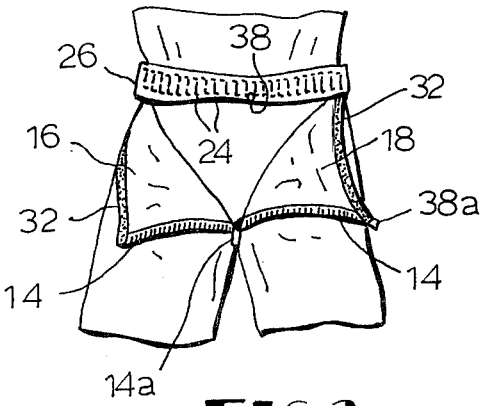
FIG. 3 shows an enlarged view of the instant invention as shown in FIG. 1.

FIG. 3 shows elasticized portion 32 constituting the upper edge of exposed flap 16 and 18 and the hook 38*a* which engages beneath and along the inside of the waistband 26 the hook fastener 38. The zipper mechanism 14*a* engaged to the zipper sides 14 on each flap and the zipper includes a panel (not shown) which hides the zipper from view when the flaps are in the closed position.

Figure 4:
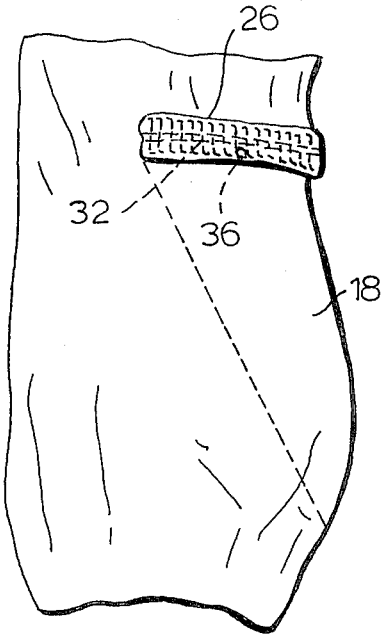
FIG. 4 shows a side elevational view of a portion of a jump suit having an access panel in accordance with the instant invention.

FIG. 4 shows the unitary garment in a closed position and the elasticized waistband 26 completely covering the waist separation portion between the flap upper edges and the lower edge of the rear, back waist panel. The waistband 26 is attached to the lower edge of the back waist panel (FIG. 5), the lower edge of the panel being element 24 while the flap upper edge 32 is engaged by the hook 38*a* to the hook fastener 38 attached on the inner side of the waistband 26.

Figure 5:
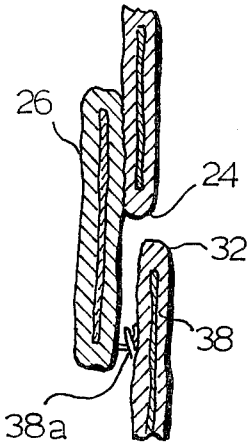
FIG. 5 shows a side elevational, cross-sectional view of the waist band and upper flap edge connection in accordance with the instant invention.

As can be seen from FIG. 5, the separation between the upper and lower portions is completely hidden by the overlapping belt 26 which being elastic in conjunction with the upper elastic portions of the flaps, when connected, insure structural integrity of the garment while still allowing the wearer to expose the rear torso area without removing the entire garment.

To operate the instant invention the wearer can undo the hook 38 and the fasteners 36 along the upper belt portion and then unzip the flaps folding the flaps over at approximately a 35° angle. The reverse procedure is followed to close the panel.

Figure 6:
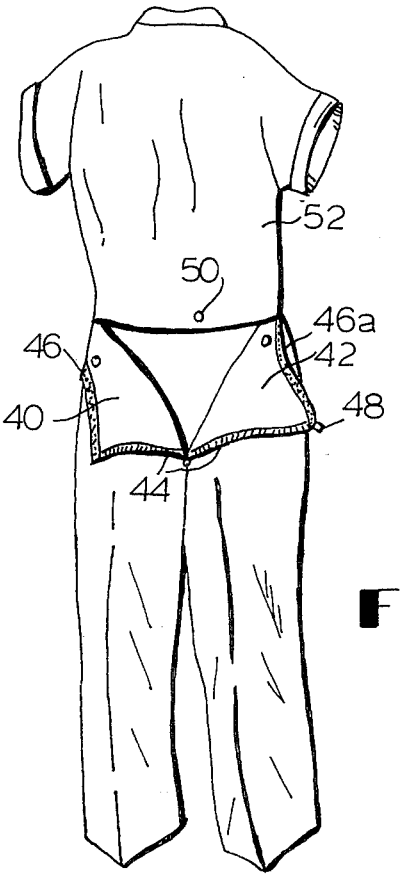
FIG. 6 is a back elevational view of an alternate embodiment of the instant invention in the open position.

FIG. 6 shows an alternate embodiment of the rear of the jumpsuit with flaps 40 and 42 open by virtue of zipper 44 being open which allows for the exposure of the rear torso portion of the wearer. The garment panels 40 and 42 each have an elasticized upper edge portion 46 and 46*a* and the panel 42 includes a hook 48 connected along the outside upper edge portion. The inside lower edge portion of the upper portion of the jumpsuit includes a hook 50 which engages with a hook 48 when the flaps are in the closed position. The lower edge portion of the upper portion of the jumpsuit also extends downwardly over the upper edges of the flaps 40 and 42 when they are in the closed position.

Figure 7:
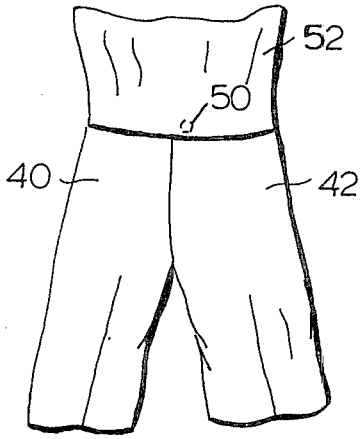
FIG. 7 shows the embodiment of FIG. 6 in the closed position.

FIG. 7 shows the garment as it is normally worn with the zipper 44 enclosed and hidden, the flaps 40 and 42 being secured to the lower edge portion of the upper portion 52 of the jump suit by the fastener 48 and the hook 50. The lower edge portion of the upper portion 52 of the jumpsuit overlaps the upper flap edges 44, hiding them from view, giving the garment a complete unitary appearance, while the fastener and hook in conjunction with the elasticized edges of the flap 16 and 18 provide structural rigidity, insuring a proper fit of the garment, preventing sagging or the like while completely hiding the access panel and separation between the flaps in the waist panel.

Figure 8:
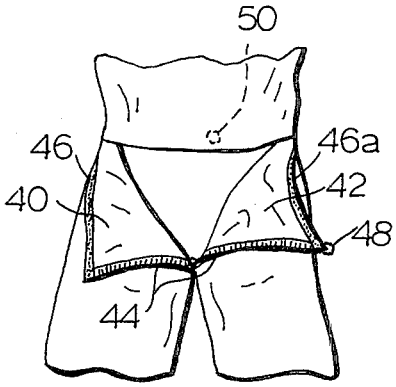
FIG. 8 shows an enlarged view of the alternate embodiment as shown in FIG. 6.

FIG. 8 shows elasticized portions 46 and 46*a* constituting the upper edge of the exposed flap 40 and 42 and the hook 48 which engages the hook fastener 50 along the lower edge portion of the upper portion of the jumpsuit.

Figure 9:
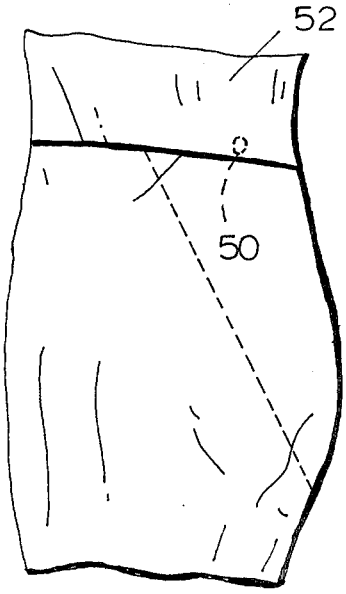
FIG. 9 shows a side elevational view of a portion of the embodiment of FIG. 6.

FIG. 9 shows the entire garment in a closed position and the lower elasticized edge portion of the upper portion 52 overlapping the elasticized portions 46 and 46*a* giving a finished appearance to the garment.

Figure 10:
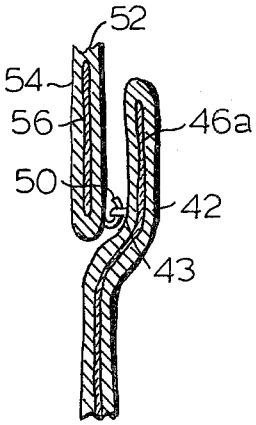
FIG. 10 shows a side elevational cross-sectional view of the waistband and upper flap edge connection in accordance with the embodiment of FIG. 6.

As can be seen from FIG. 10, the lower edge portion 54 of the upper portion 52 has an elasticized portion 56 built therein. The flap 42 also has an elastic portion 46*a* built thereon. As shown the hook 48 engages with the fastener 50 to maintain the upper and lower portions of the jumpsuit in the proper position.

Referring to FIGS. 15 and 16, the upper portion 60 of the jumpsuit can be connected to the lower portion 62 of the jumpsuit by way of a zipper 64 which runs horizontally from one side of the torso to the other side of the torso near the waist. In this embodiment a second zipper 66 is used on one side of the lower portion of the jumpsuit so that a single flap 68 is created to fold out of the way, exposing the rear portion of the torso.

Referring to FIGS. 11, 12, 13 and 14, the upper portion of the jumpsuit comprises a halter top arrangement of one continuous piece of material with overlapping panels in the back which can be tightened by way of the drawstrings 74 and 76 on each end of a panel. In FIG. 12, the lower edge portion of each rear panel 74 and 76 of the upper portion is stiched to the upper edge portion of the lower portion of the jumpsuit. The rear of the jumpsuit is opened by virtue of a zipper 78 inserted in the rear seam. In order to expose the rear torso portion, the wearer simply opens the zipper 78 which runs from the waist area down to the crotch area, unties the drawstrings 74 and 76 and then separates the overlapping panels 70 and 72 of the upper portion from each other providing a sufficient exposure of the rear torso portion. It should be noted that the slot 80 allows the drawstring 74 to be exposed in the front or side of the jumpsuit when the upper portion is in the closed position. The reverse procedure is followed to close the panel. It should also be noted that in the halter top jumpsuit the zipper 78 could be inserted in the side seam and run from the waist to approximately half way down the length of the lower portion of the jumpsuit and the overlapping panels 70 and 72 can be separated exposing a sufficient portion of the rear torso area, as shown in FIGS. 13 and 14. In this embodiment only the panel 70 is stiched to the upper edge of the lower portion.

The fasteners and hooks could be replaced with a fabric fastening band known under the trademark VELCRO.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved unitary pants-suit garment for covering the upper and lower torso of the wearer, said garment having an upper opening for the neck of the wearer, sleeves and pant legs, said garment comprising:

a unitary torso enclosing garment having a vertical opening in the mid-frontal area extending from the neck opening to the waist area;

first hidden zipper connected along said garment front opening for closing said front opening;

said garment having a rear lower torso, triangular shaped panel formed by a horizontal, rear, waist high opening and a vertical, side opening, said panel horizontal and vertical openings being of sufficient length to permit exposure of the lower rear torso of the wearer;

second hidden zipper connected to said horizontal rear opening; and third hidden zipper connected to said vertical side opening whereby said triangular shaped garment panel is not distinguishable from said overall garment when said second and third zippers are closed.

* * * * *